US007960079B2

(12) United States Patent
Wu

(10) Patent No.: US 7,960,079 B2
(45) Date of Patent: Jun. 14, 2011

(54) PHENAZINE CONTAINING PHOTOCONDUCTORS

(75) Inventor: Jin Wu, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 620 days.

(21) Appl. No.: 12/112,294

(22) Filed: Apr. 30, 2008

(65) Prior Publication Data

US 2009/0274966 A1 Nov. 5, 2009

(51) Int. Cl.
*G03G 5/047* (2006.01)

(52) U.S. Cl. ..... 430/58.5; 430/59.1; 430/58.8; 430/58.75; 430/970

(58) Field of Classification Search ..... 430/58.8, 430/58.75, 58.5, 59.1, 970
See application file for complete search history.

(56) References Cited

U.S. PATENT DOCUMENTS

| | | | | |
|---|---|---|---|---|
| 4,265,990 | A | 5/1981 | Stolka et al. | |
| 4,555,463 | A | 11/1985 | Hor et al. | |
| 4,587,189 | A | 5/1986 | Hor et al. | |
| 5,153,094 | A | 10/1992 | Kazmaier et al. | |
| 5,166,339 | A | 11/1992 | Duff et al. | |
| 5,189,155 | A | 2/1993 | Mayo et al. | |
| 5,189,156 | A | 2/1993 | Mayo et al. | |
| 5,389,478 | A * | 2/1995 | Yoshida et al. | 430/58.5 |
| 5,473,064 | A | 12/1995 | Mayo et al. | |
| 5,482,811 | A | 1/1996 | Keoshkerian et al. | |
| 5,521,306 | A | 5/1996 | Burt et al. | |
| 6,913,863 | B2 | 7/2005 | Wu et al. | |
| 7,871,746 | B2 | 1/2011 | Wu | |
| 7,897,311 | B2 | 3/2011 | Wu | |
| 2004/0126685 | A1 * | 7/2004 | Horgan et al. | 430/58.3 |
| 2006/0105254 | A1 * | 5/2006 | Wu et al. | 430/59.5 |
| 2009/0274965 | A1 | 11/2009 | Wu et al. | |
| 2009/0274967 | A1 | 11/2009 | Wu et al. | |
| 2009/0274968 | A1 | 11/2009 | Wu et al. | |
| 2009/0274970 | A1 | 11/2009 | Wu et al. | |

FOREIGN PATENT DOCUMENTS

| | | | |
|---|---|---|---|
| JP | 62249166 | A * | 10/1987 |
| JP | 02134644 | A * | 5/1990 |
| JP | 05088388 | A * | 4/1993 |

OTHER PUBLICATIONS

English language translation of JP 05-088388 (Apr. 1993).*
Diamond, Arthur S & David Weiss (eds.) Handbook of Imaging Materials, 2nd ed.. New York: Marcel-Dekker, Inc. (Nov. 2001) pp. 401-403.*
English language translation of JP 62-249166 (Oct. 1987).*
Jin Wu et al., U.S. Appl. No. 11/869,231 on Additive Containing Photogenerating Layer Photoconductors, filed Oct. 9, 2007.
Jin Wu et al., U.S. Appl. No. 11/869,246 on Phosphonium Containing Photogenerating Layer Photoconductors, filed Oct. 9, 2007.
Jin Wu et al., U.S. Appl. No. 11/869,252 on Additive Containing Charge Transport Layer Photoconductors, filed Oct. 9, 2007.
Jin Wu et al., U.S. Appl. No. 11/869,258 on Imidazolium Salt Containing Charge Transport Layer Photoconductors, filed Oct. 9, 2007.
Jin Wu et al., U.S. Appl. No. 11/869,265 on Phosphonium Containing Charge Transport Layer Photoconductors, filed Oct. 9, 2007.
Jin Wu et al., U.S. Appl. No. 11/869,269 on Charge Trapping Releaser Containing Charge Transport Layer Photoconductors, filed Oct. 9, 2007.
Jin Wu et al., U.S. Appl. No. 11/869,279 on Charge Trapping Releaser Containing Photogenerating Layer Photoconductors, filed Oct. 9, 2007.
Jin Wu, U.S. Appl. No. 11/869,284 on Salt Additive Containing Photoconductors, filed Oct. 9, 2007.
Liang-Bih Lin et al., U.S. Appl. No. 11/800,108 on Photoconductors, filed May 4, 2007.
Liang-Bih Lin et al., U.S. Appl. No. 11/800,129 on Photoconductors, filed May 4, 2007.
Jin Wu et al., U.S. Appl. No. 11/848,428 on Photoconductors, filed Aug. 31, 2007.
Jin Wu, U.S. Appl. No. 11/848,417 on Light Stabilizer Containing Photoconductors, filed Aug. 31, 2007.
Jin Wu, U.S. Appl. No. 11/848,439 on Boron Containing Photoconductors, filed Aug. 31, 2007.
Jin Wu et al., U.S. Appl. No. 12/059,555 on Hydroxyquinoline Containing Photoconductors, filed Mar. 31, 2008.
Jin Wu, U.S. Appl. No. 11/848,448 on Triazole Containing Photoconductors, filed Aug. 31, 2007.

* cited by examiner

*Primary Examiner* — Christopher RoDee
(74) *Attorney, Agent, or Firm* — Oliff & Berridge, PLC

(57) ABSTRACT

A photoconductor that includes, for example, a supporting substrate, a photogenerating layer, and at least one charge transport layer comprised of at least one charge transport component, and wherein at least one of the photogenerating layer and charge transport layer contains a phenazine.

20 Claims, No Drawings

PHENAZINE CONTAINING PHOTOCONDUCTORS

CROSS REFERENCE TO RELATED APPLICATIONS

Copending U.S. Application No. 12/112,206, U.S. Publication 20090274965, on Metal Mercaptoimidazoles Containing Photoconductors, filed Apr. 30, 2008, the disclosure of which is totally incorporated herein by reference U.S. application Ser. No. 12/112,292, now U.S. Pat. No. 7,871,746, on Thiophthalimides Containing Photoconductors, filed Apr. 20, 2008, the disclosure of which is totally incorporated herein by reference.

Copending U.S. application Ser. No. 12/112,308, U.S. Publication 20090274967 on Quinoxaline Containing Photoconductors, filed Apr. 20, 2008 the disclosure of which is totally incorporated herein by reference.

Copending U.S. application Ser. No. 12/112,322, U.S. Publication No. 20090274970 on Carbazole Containing Charge Transport Layer Photoconductors, Apr. 20, 2008, the disclosure of which is totally incorporated herein by reference.

Copending U.S. application Ser. No. 12/112,330, U.S. Publication No. 20090274968 on Pyrazine Containing Charge Transport Layer Photoconductors, filed Apr. 30, 2008, the disclosure of which is totally incorporated herein by reference.

U.S. application Ser. No. 12/112,338, now U.S. Pat. No. 7,897,311 on Phenothiazine Containing Photogenerating Layer Photoconductors, filed Apr. 30, 2008 the disclosure of which is totally incorporated herein by reference.

U.S. application Ser. No. 11/848,428, U.S Pat. No. 20090061337, entitled Photoconductors, filed Aug. 31, 2007, the disclosure of which is totally incorporated herein by reference, illustrates a photoconductor comprising a supporting substrate, a photogenerating layer, and at least one charge transport layer comprised of at least one charge transport component, and wherein the photogenerating layer contains a triazine.

U.S. application Ser. No. 11/848,417, US. Patent Publication 20090061336, entitled Light Stabilizer Containing Photoconductors, filed Aug. 31, 2007, the disclosure of which is totally incorporated herein by reference, illustrates a photoconductor comprising a supporting substrate, a photogenerating layer, and at least one charge transport layer comprised of at least one charge transport component, and wherein the photogenerating layer contains a light stabilizer.

U.S. application Ser. No. 11/848,439, now U.S. Pat. No. 7,670,738, entitled Boron Containing Photoconductors, filed Aug. 31, 2007, the disclosure of which is totally incorporated herein by reference, illustrates a photoconductor comprising a supporting substrate, a photogenerating layer, and at least one charge transport layer comprised of at least one charge transport component, and wherein the photogenerating layer contains a boron compound.

U.S. application Ser. No. 12/059,555, U.S. Publication No. 20090246662, entitled Hydroxyquinoline Containing Photoconductors, filed Mar. 31, 2008, the disclosure of which is totally incorporated herein by reference, illustrates a photoconductor comprising a supporting substrate, a photogenerating layer, and at least one charge transport layer comprised of at least one charge transport component, and wherein the photogenerating layer contains a hydroxyquinoline.

U.S. application Ser. No. 11/848,448, now U.S. Pat. No. 7,785,758, entitled Triazole Containing Photoconductors, filed Aug. 31, 2007, the disclosure of which is totally incorporated herein by reference, illustrates a photoconductor comprising a supporting substrate, a photogenerating layer, and at least one charge transport layer comprised of at least one charge transport component, and wherein said photogenerating layer contains a triazole.

U.S. application Ser. No. 11/869,231, now U.S Pat. No. 7,901,856, filed Oct. 9, 2007, entitled Additive Containing Photogenerating Layer Photoconductors, the disclosure of which is totally incorporated herein by reference, illustrates a photoconductor comprising a supporting substrate, a photogenerating layer, and at least one charge transport layer comprised of at least one charge transport component, and wherein the photogenerating layer contains at least one of an ammonium salt and an imidazolium salt.

U.S. application Ser. No. 11/869,246, U.S. Publication No. 20090092914, filed Oct. 9, 2007, entitled Phosphonium Containing Photogenerating Layer Photoconductors, the disclosure of which is totally incorporated herein by reference, illustrates a photoconductor comprising a supporting substrate, a phosphonium salt containing photogenerating layer, and at least one charge transport layer comprised of at least one charge transport component.

U.S. application Ser. No. 11/869,252, U.S. Patent Publication No. 20090092911, filed Oct. 9, 2007, entitled Additive Containing Charge Transport Layer Photoconductors, the disclosure of which is totally incorporated herein by reference, illustrates a photoconductor comprising a supporting substrate, a photogenerating layer, and at least one charge transport layer comprised of at least one charge transport component, and wherein the charge transport layer contains at least one ammonium salt.

U.S. application Ser. No. 11/869,258, U.S. Publication 20090092912, filed Oct. 9, 2007, entitled Imidazolium Salt Containing Charge Transport Layer Photoconductors, the disclosure of which is totally incorporated herein by reference, illustrates a photoconductor comprising a supporting substrate, a photogenerating layer, and at least one charge transport layer comprised of at least one charge transport component, and wherein at least one charge transport layer contains at least one imidazolium salt.

U.S. application Ser. No. 11/869,265, now U.S. Pat. No. 7,709,168, filed Oct. 9, 2007, entitled Phosphonium Containing Charge Transport Layer Photoconductors, the disclosure of which is totally incorporated herein by reference, there is disclosed a photoconductor comprising a supporting substrate, a photogenerating layer, and at least one charge transport layer comprised of at least one charge transport component, and wherein the at least one charge transport layer contains at least one phosphonium salt.

U.S. application Ser. No. 11/869,269, now U.S. Pat. No. 7,709,169, filed Oct. 9, 2007, entitled Charge Trapping Releaser Containing Charge Transport Layer Photoconductors, the disclosure of which is totally incorporated herein by reference, illustrates a photoconductor comprising a supporting substrate, a photogenerating layer, and at least one charge transport layer comprised of at least one charge transport component, and wherein the at least one charge transport layer contains at least one charge trapping releaser.

U.S. application Ser. No. 11/869,279, now U.S. Pat. No. 7,687,212, filed Oct. 9, 2007, entitled Charge Trapping Releaser Containing Photogenerating Layer Photoconductors, the disclosure of which is totally incorporated herein by reference, there is disclosed a photoconductor comprising a supporting substrate, a photogenerating layer, and at least one charge transport layer comprised of at least one charge transport component, and wherein the photogenerating layer contains at least one charge trapping releaser component.

U.S. application Ser. No. 11/869,284, U.S. Publication No. 20090092910, filed Oct. 9, 2007, entitled Salt Additive Containing Photoconductors, the disclosure of which is totally incorporated herein by reference, illustrates a photoconductor comprising a supporting substrate, a photogenerating layer, and at least one charge transport layer comprised of at least one charge transport component, and wherein at least one of the photogenerating layer and the charge transport layer contains at least one of a pyridinium salt and a tetrazolium salt.

In U.S. Application Ser. No. 11/800,129, U.S. Publication No. 20080274419, entitled Photoconductors, filed May 4, 2007, the disclosure of which is totally incorporated herein by reference, there is illustrated a photoconductor comprising a supporting substrate, a photogenerating layer, and at least one charge transport layer comprised of at least one charge transport component, and wherein the photogenerating layer contains a bis(pyridyl)alkylene.

In U.S. application Ser. No. 11/800,108, now U.S. Pat. No. 7,662,526, entitled Photoconductors, filed May 4, 2007, the disclosure of which is totally incorporated herein by reference, there is illustrated a photoconductor comprising a supporting substrate, a photogenerating layer, and at least one charge transport layer comprised of at least one charge transport component, and wherein the charge transport layer contains a benzoimidazole.

BACKGROUND

This disclosure is generally directed to imaging, such as xerographic imaging and printing members, photoreceptors, photoconductors, and the like. More specifically, the present disclosure is directed to drum, multilayered drum, and flexible, belt imaging members, or devices comprised of a supporting medium like a substrate, a photogenerating layer, and a charge transport layer, including a plurality of charge transport layers, such as a first charge transport layer and a second charge transport layer, and wherein at least one of the photogenerating layer and charge transport layer contains as an additive or dopant a phenazine and a photoconductor comprised of a supporting medium like a substrate, a phenazine containing photogenerating layer, and a phenazine charge transport layer that results in photoconductors with a number of advantages, such as in embodiments, minimal charge deficient spots (CDS); the minimization or substantial elimination of undesirable ghosting on developed images, such as xerographic images, including acceptable ghosting at various relative humidities; excellent cyclic and stable electrical properties; compatibility with the photogenerating and charge transport resin binders; and acceptable lateral charge migration (LCM) characteristics, such as for example, excellent LCM resistance. At least one in embodiments refers, for example, to one, to from 1 to about 10, to from 2 to about 6; to from 2 to about 4; 2, and the like.

Also included within the scope of the present disclosure are methods of imaging and printing with the photoconductor devices illustrated herein. These methods generally involve the formation of an electrostatic latent image on the imaging member, followed by developing the image with a toner composition comprised, for example, of thermoplastic resin, colorant such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, the imaging members and flexible belts disclosed herein can be selected for the Xerox Corporation iGEN3® machines that generate with some versions over 100 copies per minute. Processes of imaging, especially xerographic imaging and printing, including digital, and/or color printing are thus encompassed by the present disclosure.

The photoconductors disclosed herein are in embodiments sensitive in the wavelength region of, for example, from about 400 to about 900 nanometers, and in particular from about 650 to about 850 nanometers, thus diode lasers can be selected as the light source. Moreover, the photoconductors disclosed herein are in embodiments useful in high resolution color xerographic applications, particularly high-speed color copying and printing processes.

REFERENCES

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer.

Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N'-diphenyl-N,N'-bis(3-methylphenyl)-1,1'-biphenyl-4,4'-diamine dispersed in a polycarbonate binder as a hole transport layer. The above components, such as the photogenerating compounds and the aryl amine charge transport, can be selected for the imaging members of the present disclosure in embodiments thereof.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water; concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, where a pigment precursor Type I chlorogallium phthalocyanine is prepared by the reaction of gallium chloride in a solvent, such as N-methylpyrrolidone, present in an amount of from about 10 parts to about 100 parts, with 1,3-diiminoisoindolene ($DI^3$) in an amount of from about 1 part to about 10 parts, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

The appropriate components and processes of the above recited patents may be selected for the present disclosure in embodiments thereof.

SUMMARY

Disclosed are photoconductors that contain a dopant in the photogenerating layer, or charge transport layer, and where there are permitted, acceptable photoinduced discharge (PIDC) values, excellent lateral charge migration (LCM) resistance, reduced charge deficient spots (CDS) counts, and excellent cyclic stability properties.

Additionally disclosed are flexible belt imaging members containing optional hole blocking layers comprised of, for example, amino silanes, (throughout in this disclosure plural also includes nonplural, thus there can be selected a single amino silane), metal oxides, phenolic resins, and optional phenolic compounds, and which phenolic compounds contain at least two, and more specifically, two to ten phenol groups or phenolic resins with, for example, a weight average molecular weight ranging from about 500 to about 3,000, permitting, for example, a hole blocking layer with excellent efficient electron transport which usually results in a desirable photoconductor low residual potential $V_{low}$.

The photoconductors illustrated herein, in embodiments, possess low background and/or minimal charge deficient spots (CDS).

EMBODIMENTS

A photoconductor comprising a supporting substrate, a photogenerating layer, and at least one charge transport layer, such as 1, 2, 3, or 4 layers, comprised of at least one charge transport component, and wherein at least one of the photogenerating layer and the charge transport layer contains a phenazine; a photoconductor comprised in sequence of a photogenerating layer, and a charge transport layer, and wherein the photogenerating layer contains a phenazine and a photogenerating pigment; and a photoconductor comprising a supporting substrate, a photogenerating layer, and a charge transport layer; and wherein the charge transport layer is comprised of at least one charge transport component, a resin binder, and a phenazine.

Aspects of the present disclosure relate to a photoconductor comprising a supporting substrate, a photogenerating layer, and at least one charge transport layer comprised of at least one charge transport component, and where the photogenerating layer contains at least one photogenerating component and the additive or dopant as illustrated herein; a photoconductor comprising a supporting substrate, a phenazine containing photogenerating layer, and a phenazine charge transport layer comprised of at least one charge transport component; a photoconductor comprised in sequence of an optional supporting substrate, a hole blocking layer, an adhesive layer, a phenazine photogenerating layer, or a phenazine charge transport layer; a photoconductor wherein the charge transport component is an aryl amine selected from the group consisting of N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]4,4'-diamine, N,N'-bis(4-butylphenyl) -N,N'-bis-(4-isopropylphenyl)-[p-terphenyll]-4,4'-diamine, N,N'-bis (4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine, and mixtures thereof; and wherein the at least one charge transport layer is from 1 to about 4; a photoconductor wherein the photogenerating pigment is a hydroxygallium phthalocyanine, a titanyl phthalocyanine, a halogallium phthalocyanine or a perylene; a photoconductor wherein the phenazine is present in at least one of the charge transport and photogenerating layer in an amount of, for example, from about 0.01 to about 25, from about 0.1 to about 15, or from about 0.2 to about 10 weight percent; a photoconductor wherein the substrate is comprised of a conductive material, and a flexible photoconductive imaging member comprised in sequence of a supporting substrate, photogenerating layer thereover, a charge transport layer, and a protective top overcoat layer; a photoconductor which includes a hole blocking layer and an adhesive layer where the adhesive layer is situated between the hole blocking layer and the photogenerating layer, and the hole blocking layer is situated between the substrate and the adhesive layer; and a photoconductor wherein the additive or dopant can be selected in various effective amounts, such as for example, from about 0.3 to about 7 weight percent.

ADDITIVE/DOPANT EXAMPLES

Examples of the photogenerating and charge transport additive or dopant include, for example, a number of known suitable components, such as phenazines.

Phenazine examples included in at least one of the photogenerating layer and charge transport layer can be represented by the following structure/formula

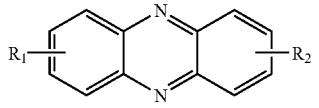

wherein $R_1$, and $R_2$ are independently hydrogen, or substituting groups having from 0 to about 24 carbon atoms, from about 1 to about 20 carbon atoms, from 1 to about 12 carbon atoms, and from 2 to about 8 carbon atoms, and more specifically, thio, nitro, hydroxyl; alkyl such as methyl, ethyl, n-propyl, isopropyl, n-butyl, isobutyl; aryl such as phenyl, naphthyl, styryl, biphenylyl; thio such as methylthio, ethylthio; alkoxy such as methoxy, ethoxy; halo such as chloro, bromo; and the like.

Specific phenazine examples include, for example, phenazine, 1-hydroxyphenazine, 1-methoxyphenazine, 10,11-dimethyldibenzo[A,C]phenazine, 11,12-dimethyldibenzo[A,C]phenazine, 11-nitrodibenzo[A,C]phenazine, benzo(A)naphtha[1,2-C]phenazine, 10,11-dichlorodibenzo[A,C]phenazine, 11-methylthiodibenzo[A,C]phenazine, and the like, and mixtures thereof. The designations A and C represent the position substitutions, for example, A represents the 1, 2 substitutions, and C represents the 3, 4 substitutions.

In embodiments, the phenazine incorporated into the photogenerating layer, the charge transport layer, or both the photogenerating layer and charge transport layer, for example at least one charge transport layer, and which photogenerating layer also includes at least one photogenerating pigment and a resin binder is represented by the following structures/formulas

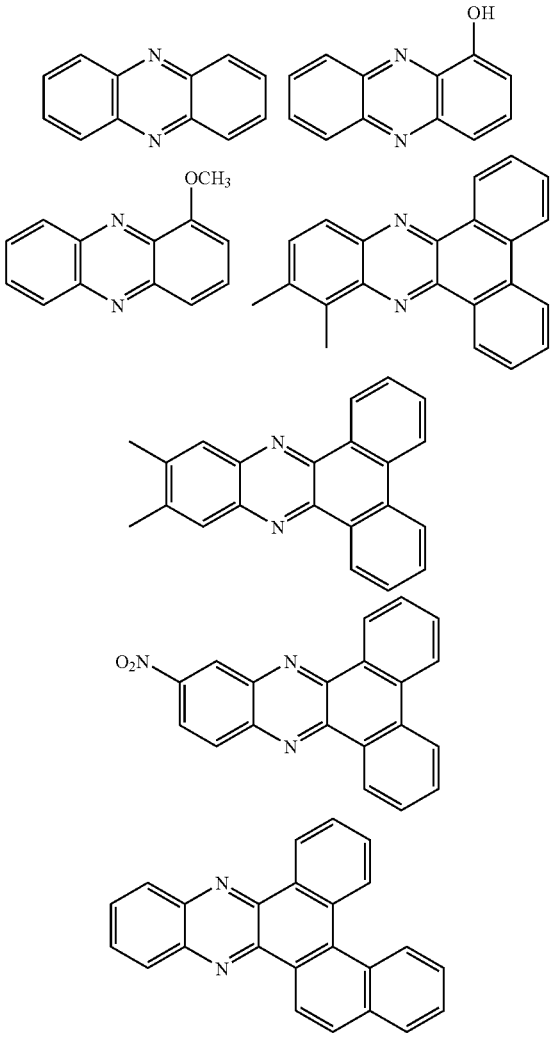

-continued

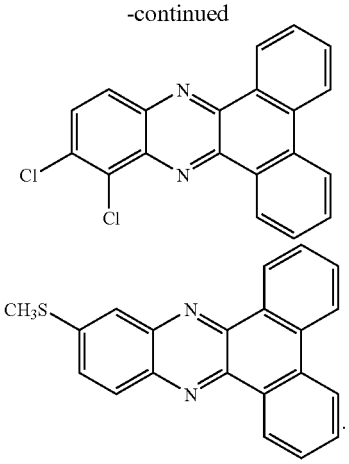

Photoconductive Layer Components

There can be selected for the photoconductors disclosed herein a number of known layers, such as substrates, photogenerating layers, charge transport layers, hole blocking layers, adhesive layers, protective overcoat layers, and the like. Examples, thicknesses, specific components of many of these layers include the following.

The thickness of the photoconductor substrate layer depends on many factors, including economical considerations, electrical characteristics, adequate flexibility, availability and cost of the specific components for each layer, and the like, thus this layer may be of a substantial thickness, for example about 3,000 microns, such as from about 1,000 to about 2,000 microns, from about 500 to about 1,000 microns, or from about 300 to about 700 microns, ("about" throughout includes all values in between the values recited) or of a minimum thickness. In embodiments, the thickness of this layer is from about 75 microns to about 300 microns, or from about 100 to about 150 microns.

The photoconductor substrate may be opaque or substantially transparent, and may comprise any suitable material having the required mechanical properties. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired, and economical considerations. For a drum, this layer may be of a substantial thickness of, for example, up to many centimeters or of a minimum thickness of less than a millimeter. Similarly, a flexible belt may be of a substantial thickness of, for example, about 250 micrometers, or of a minimum thickness of less than about 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, supporting substrate layers selected for the photoconductors of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo) perylene, titanyl phthalocyanines, and the like, and more specifically, vanadyl phthalocyanines, Type V hydroxygallium phthalocyanines, high sensitivity titanyl phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers and the amount of photogenerating material contained in the photogenerating layer. Accordingly, this layer can be of a thickness of, for example, from about 0.05 micron to about 10 microns, and more specifically, from about 0.25 micron to about 2 microns when, for example, the photogenerating compositions are present in an amount of from about 30 to about 75 percent by volume. The maximum thickness of this layer in embodiments is dependent primarily upon factors, such as photosensitivity, electrical properties, and mechanical considerations.

The photogenerating composition or pigment can be present in a resinous binder composition in various amounts inclusive of up to 100 percent by weight. Generally, however, from about 5 percent by volume to about 95 percent by volume of the photogenerating pigment is dispersed in about 95 percent by volume to about 5 percent by volume of the resinous binder, or from about 20 percent by volume to about 30 percent by volume of the photogenerating pigment is dispersed in about 70 percent by volume to about 80 percent by volume of the resinous binder composition. In one embodiment, about 90 percent by volume of the photogenerating pigment is dispersed in about 10 percent by volume of the resinous binder composition, and which resin may be selected from a number of known polymers, such as poly (vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium, and the like, hydrogenated amorphous silicon and compounds of silicon and germanium, carbon, oxygen, nitrogen, and the like fabricated by vacuum evaporation or deposition. The photogenerating layers may also comprise inorganic pigments of crystalline selenium and its alloys; Groups II to VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos, and the like dispersed in a film forming polymeric binder and fabricated by solvent coating techniques.

In embodiments, examples of photogenerating layer binders are thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene, and acrylonitrile copolymers, poly(vinyl chloride), vinyl chloride and vinyl acetate copolymers, acrylate copolymers, alkyd resins, cellulosic film formers, poly(amideimide), styrenebutadiene copolymers, vinylidene chloride-vinyl chloride copolymers, vinyl acetate-vinylidene chloride copolymers, styrene-alkyd resins, poly(vinyl carbazole), and the like. These polymers may be block, random, or alternating copolymers.

Various suitable and conventional known processes may be used to mix, and thereafter apply the photogenerating layer coating mixture, like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air drying, and the like.

The final dry thickness of the photogenerating layer is as illustrated herein, and can be, for example, from about 0.01 to about 30 microns after being dried at, for example, about 40° C. to about 150° C. for about 15 to about 90 minutes. More specifically, a photogenerating layer of a thickness, for example, of from about 0.1 to about 30, or from about 0.5 to about 2 microns can be applied to or deposited on the substrate, on other surfaces in between the substrate and the charge transport layer, and the like. A charge blocking layer or hole blocking layer may optionally be applied to the electrically conductive surface prior to the application of a photogenerating layer. When desired, an adhesive layer may be included between the charge blocking or hole blocking layer or interfacial layer and the photogenerating layer. Usually, the photogenerating layer is applied onto the adhesive layer, and a charge transport layer or plurality of charge transport layers are formed on the photogenerating layer. This structure may have the photogenerating layer on top of or below the charge transport layer.

In embodiments, a suitable known adhesive layer can be included in the photoconductor. Typical adhesive layer materials include, for example, polyesters, polyurethanes, and the like. The adhesive layer thickness can vary and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As an optional adhesive layer or layers usually in contact with or situated between the hole blocking layer and the photogenerating layer, there can be selected various known substances inclusive of copolyesters, polyamides, poly(vinyl butyral), poly(vinyl alcohol), polyurethane, and polyacrylonitrile. This layer is, for example, of a thickness of from about 0.001 micron to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

The optional hole blocking or undercoat layer or layers for the imaging members of the present disclosure can contain a number of components including known hole blocking components, such as amino silanes, doped metal oxides, a metal oxide like titanium, chromium, zinc, tin and the like; a mixture of phenolic compounds and a phenolic resin or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene) bisphenol), P (4,4'-(1,4-phenylene diisopropylidene)bisphenol), S (4,4'-sulfonyldiphenol), and Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of a suitable component like a metal oxide, such as $TiO_2$, from about 20 weight percent to about 70 weight percent, and more specifically, from about 25 weight percent to about 50 weight percent of a phenolic resin; from about 2 weight percent to about 20 weight percent, and, more specifically, from about 5 weight percent to about 15 weight percent of a phenolic compound preferably containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9. To the above dispersion are added a phenolic compound and dopant followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM™ 29159 and 29101 (available from OxyChem Company), and DURITE™ 97 (available from Borden Chemical); formaldehyde polymers with ammonia, cresol and phenol, such as VARCUM™ 29112 (available from OxyChem Company); formaldehyde polymers with 4,4'-(1-methylethylidene)bisphenol, such as VARCUM™ 29108 and 29116 (available from OxyChem Company); formaldehyde polymers with cresol and phenol, such as VARCUM™ 29457 (available from OxyChem Company), DURITE™ SD-423A, SD-422A (available from Borden Chemical); or formaldehyde polymers with phenol and p-tert-butylphenol, such as DURITE™ ESD 556C (available from Border Chemical).

The optional hole blocking layer may be applied to the substrate. Any suitable and conventional blocking layer capable of forming an electronic barrier to holes between the adjacent photoconductive layer (or electrophotographic imaging layer) and the underlying conductive surface of substrate may be selected.

A number of charge transport components can be included in the charge transport layer, which layer generally is of a thickness of from about 5 microns to about 75 microns, and more specifically, of a thickness of from about 10 microns to about 40 microns.

Examples of charge transport components are aryl amines of the following formulas/structures

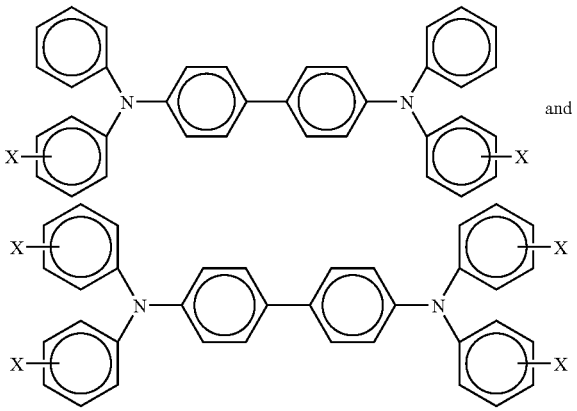

and wherein X is as illustrated herein such as alkyl, aryl, alkoxy or halo.

Moreover, the photogenerating layer can be comprised of a high sensitivity titanyl phthalocyanine component generated by the processes as illustrated in copending application U.S. application Ser. No. 10/992,500, U.S. Publication No. 20060105254, the disclosure of which is totally incorporated herein by reference.

A number of titanyl phthalocyanines, or oxytitanium phthalocyanines, are suitable photogenerating pigments known to absorb near infrared light around 800 nanometers and may exhibit improved sensitivity compared to other pigments, such as, for example, hydroxygallium phthalocyanine. Generally, titanyl phthalocyanine is known to have five main crystal forms known as Types I, II, III, X, and IV. For example, U.S. Pat. Nos. 5,189,155 and 5,189,156, the entire disclosures of which are incorporated herein by reference, disclose a number of methods for obtaining various polymorphs of titanyl phthalocyanine. Additionally, U.S. Pat. Nos. 5,189,155 and 5,189,156 are directed to processes for obtaining Types I, X, and IV phthalocyanines. U.S. Pat. No. 5,153,094, the entire disclosure of which is incorporated herein by reference, relates to the preparation of titanyl phthalocyanine polymorphs including Types I, II, III, and IV polymorphs. U.S. Pat. No. 5,166,339, the disclosure of which is totally incorporated herein by reference, discloses processes for preparing Types I, IV, and X titanyl phthalocyanine polymorphs, as well as the preparation of two polymorphs designated as Type Z-1 and Type Z-2.

To obtain a titanyl phthalocyanine-based photoreceptor having high sensitivity to near infrared light, it is believed of value to control not only the purity and chemical structure of the pigment, as is generally the situation with organic photoconductors, but also to prepare the pigment in a certain crystal modification. Consequently, it is still desirable to provide a photoconductor where the titanyl phthalocyanine is generated by a process that will provide high sensitivity titanyl phthalocyanines.

In embodiments, the Type V phthalocyanine pigment included in the photogenerating layer can be generated by dissolving Type I titanyl phthalocyanine in a solution comprising a trihaloacetic acid and an alkylene halide; adding the resulting mixture comprising the dissolved Type I titanyl phthalocyanine to a solution comprising an alcohol and an alkylene halide thereby precipitating a Type Y titanyl phthalocyanine; and treating the resulting Type Y titanyl phthalocyanine with monochlorobenzene.

With further respect to the titanyl phthalocyanines selected for the photogenerating layer, such phthalocyanines exhibit a crystal phase that is distinguishable from other known titanyl phthalocyanine polymorphs, and are designated as Type V polymorphs prepared by converting a Type I titanyl phthalocyanine to a Type V titanyl phthalocyanine pigment. The processes include converting a Type I titanyl phthalocyanine to an intermediate titanyl phthalocyanine, which is designated as a Type Y titanyl phthalocyanine, and then subsequently converting the Type Y titanyl phthalocyanine to a Type V titanyl phthalocyanine.

In one embodiment, the process comprises (a) dissolving a Type I titanyl phthalocyanine in a suitable solvent; (b) adding the solvent solution comprising the dissolved Type I titanyl phthalocyanine to a quenching solvent system to precipitate an intermediate titanyl phthalocyanine (designated as a Type Y titanyl phthalocyanine); and (c) treating the resultant Type Y phthalocyanine with a halo, such as, for example, monochlorobenzene to obtain a resultant high sensitivity titanyl phthalocyanine, which is designated herein as a Type V titanyl phthalocyanine. In another embodiment, prior to treating the Type Y phthalocyanine with a halo, such as monochlorobenzene, the Type Y titanyl phthalocyanine may be washed with various solvents including, for example, water, and/or methanol. The quenching solvents system to which the solution comprising the dissolved Type I titanyl phthalocyanine is added comprises, for example, an alkyl alcohol, and an alkylene halide.

The process further provides a titanyl phthalocyanine having a crystal phase distinguishable from other known titanyl phthalocyanines. The titanyl phthalocyanine Type V prepared by a process according to the present disclosure is distinguishable from, for example, Type IV titanyl phthalocyanines in that a Type V titanyl phthalocyanine exhibits an X-ray powder diffraction spectrum having four characteristic peaks at 9.0°, 9.6°, 24.0°, and 27.2°, while Type IV titanyl phthalocyanines typically exhibit only three characteristic peaks at 9.6°, 24.0°, and 27.2°.

In a process embodiment for preparing a high sensitivity phthalocyanine in accordance with the present disclosure, a Type I titanyl phthalocyanine is dissolved in a suitable solvent. In embodiments, a Type I titanyl phthalocyanine is dissolved in a solvent comprising a trihaloacetic acid and an alkylene halide. The alkylene halide comprises, in embodiments, from about one to about six carbon atoms. An example of a suitable trihaloacetic acid includes, but is not limited to, trifluoroacetic acid. In one embodiment, the solvent for dissolving a Type I titanyl phthalocyanine comprises trifluoroacetic acid and methylene chloride. In embodiments, the trihaloacetic acid is present in an amount of from about one volume part to about 100 volume parts of the solvent, and the alkylene halide is present in an amount of from about one volume part to about 100 volume parts of the solvent. In one embodiment, the solvent comprises methylene chloride and trifluoroacetic acid in a volume-to-volume ratio of about 4 to 1. The Type I titanyl phthalocyanine is dissolved in the solvent by stirring for an effective period of time, such as, for example, for about 30 seconds to about 24 hours, at room temperature. The Type I titanyl phthalocyanine is dissolved by, for example, stirring in the solvent for about one hour at room temperature (about 25° C.). The Type I titanyl phthalocyanine may be dissolved in the solvent in either air or in an inert atmosphere (argon or nitrogen).

Sensitivity is a valuable electrical characteristic of electrophotographic imaging members or photoreceptors. Sensitivity may be described in two aspects. The first aspect of sensitivity is spectral sensitivity, which refers to sensitivity as a function of wavelength. An increase in spectral sensitivity implies an appearance of sensitivity at a wavelength in which previously no sensitivity was detected. The second aspect of sensitivity, broadband sensitivity, is a change of sensitivity, for example an increase at a particular wavelength previously exhibiting sensitivity, or a general increase of sensitivity encompassing all wavelengths previously exhibiting sensitivity. This second aspect of sensitivity may also be considered as change of sensitivity, encompassing all wavelengths, with a broadband (white) light exposure. A problem encountered in the manufacturing of photoreceptors is maintaining consistent spectral and broadband sensitivity from batch to batch.

Typically, flexible photoreceptor belts are fabricated by depositing the various layers of photoactive coatings onto lengthy webs that are thereafter cut into sheets. The opposite ends of each photoreceptor sheet are overlapped and ultrasonically welded together to form an imaging belt. In order to increase throughput during the web coating operation, the webs to be coated have a width of twice the width of a final belt. After coating, the web is slit lengthwise and thereafter transversely cut into predetermined lengths to form photoreceptor sheets of precise dimensions that are eventually welded into belts. The web length in a coating run may be many thousands of feet long and the coating run may take more than an hour for each layer.

The following Examples are being submitted to illustrate embodiments of the present disclosure.

Example I

Preparation of Type I Titanyl Phthalocyanine

A Type I titanyl phthalocyanine (TiOPc) was prepared as follows. To a 300 milliliter three-necked flask fitted with mechanical stirrer, condenser and thermometer maintained under an argon atmosphere were added 3.6 grams (0.025 mole) of 1,3-diiminoisoindoline, 9.6 grams (0.075 mole) of o-phthalonitrile, 75 milliliters (80 weight percent) of tetrahydronaphthalene, and 7.11 grams (0.025 mole) of titanium tetrapropoxide (all obtained from Aldrich Chemical Company except phthalonitrile which was obtained from BASF). The resulting mixture (20 weight percent of solids) was stirred and warmed to reflux (about 198° C.) for 2 hours. The resultant black suspension was cooled to about 150° C., and then was filtered by suction through a 350 milliliter, M-porosity sintered glass funnel, which had been preheated with boiling dimethyl formamide (DMF). The solid Type I TiOPc product resulting was washed with two 150 milliliter portions of boiling DMF, and the filtrate, initially black, became a light blue-green color. The solid was slurried in the funnel with 150 milliliters of boiling DMF, and the suspension was filtered. The resulting solid was washed in the funnel with 150 milliliters of DMF at 25° C., and then with 50 milliliters of methanol. The resultant shiny purple solid was dried at 70° C. overnight to yield 10.9 grams (76 percent) of pigment, which were identified as Type I TiOPc on the basis of their X-ray powder diffraction trace. Elemental analysis of the product indicated C, 66.54; H, 2.60; N, 20.31; and Ash ($TiO_2$), 13.76. TiOPc requires (theory) C, 66.67; H, 2.80; N, 19.44; and Ash, 13.86.

A Type I titanyl phthalocyanine can also be prepared in 1-chloronaphthalene or N-methylpyrrolidone as follows. A 250 milliliter three-necked flask fitted with mechanical stirrer, condenser and thermometer maintained under an atmosphere of argon was charged with 1,3-diiminoisoindolene (14.5 grams), titanium tetrabutoxide (8.5 grams), and 75 milliliters of 1-chloronaphthalene (CINP) or N-methylpyrrolidone. The mixture was stirred and warmed. At 140° C. the mixture turned dark green and began to reflux. At this time, the vapor (which was identified as n-butanol by gas chromatography) was allowed to escape to the atmosphere until the reflux temperature reached 200° C. The reaction was maintained at this temperature for two hours then was cooled to 150° C. The product was filtered through a 150 milliliter M-porosity sintered glass funnel, which was preheated to approximately 150° C. with boiling DMF, and then washed thoroughly with three portions of 150 milliliters of boiling DMF, followed by washing with three portions of 150 milliliters of DMF at room temperature, and then three portions of 50 milliliters of methanol, thus providing 10.3 grams (72 percent yield) of a shiny purple pigment, which were identified as Type I TiOPc by X-ray powder diffraction (XRPD).

Example II

Preparation of Type V Titanyl Phthalocyanine

Fifty grams of TiOPc Type I were dissolved in 300 milliliters of a trifluoroacetic acid/methylene chloride (¼, volume/volume) mixture for 1 hour in a 500 milliliter Erlenmeyer flask with magnetic stirrer. At the same time, 2,600 milliliters of methanol/methylene chloride (1/1, volume/volume) quenching mixture were cooled with a dry ice bath for 1 hour in a 3,000 milliliter beaker with magnetic stirrer, and the final temperature of the mixture was about −25° C. The resulting TiOPc solution was transferred to a 500 milliliter addition funnel with a pressure-equalization arm, and added into the cold quenching mixture over a period of 30 minutes. The mixture obtained was then allowed to stir for an additional 30 minutes, and subsequently hose vacuum filtered through a 2,000 milliliter Buchner funnel with fibrous glass frit of about 4 to about 8 μm in porosity. The pigment resulting was then well mixed with 1,500 milliliters of methanol in the funnel, and vacuum filtered. The pigment was then well mixed with 1,000 milliliters of hot water (>90° C.), and vacuum filtered in the funnel four times. The pigment was then well mixed with 1,500 milliliters of cold water, and vacuum filtered in the funnel. The final water filtrate was measured for conductivity, which was below 10 μS. The resulting wet cake contained approximately 50 weight percent of water. A small portion of the wet cake was dried at 65° C. under vacuum and a blue pigment was obtained. A representative XRPD of this pigment after quenching with methanol/methylene chloride was identified by XRPD as Type Y titanyl phthalocyanine.

The remaining portion of the wet cake was redispersed in 700 grams of monochlorobenzene (MCB) in a 1,000 milliliter bottle, and rolled for an hour. The dispersion was vacuum filtered through a 2,000 milliliter Buchner funnel with a fibrous glass frit of about 4 to about 8 μm in porosity over a period of two hours. The pigment was then well mixed with 1,500 milliliters of methanol and filtered in the funnel twice. The final pigment was vacuum dried at 60° C. to 65° C. for two days. Approximately 45 grams of the pigment were obtained. The XRPD of the resulting pigment after the MCB conversion was designated as a Type V titanyl phthalocyanine. The Type V had an X-ray diffraction pattern having characteristic diffraction peaks at a Bragg angle of $2\Theta \pm 0.2°$ at about 9.0°, 9.6°, 24.0°, and 27.2°.

Comparative Example 1

There was prepared a photoconductor with a biaxially oriented polyethylene naphthalate substrate (KALEDEX™ 2000) having a thickness of 3.5 mils, and thereover, a 0.02 micron thick titanium layer was coated on the biaxially oriented polyethylene naphthalate substrate (KALEDEX™ 2000). Subsequently, there was applied thereon, with a gravure applicator or an extrusion coater, a hole blocking layer solution containing 50 grams of 3-aminopropyl triethoxysilane (γ-APS), 41.2 grams of water, 15 grams of acetic acid, 684.8 grams of denatured alcohol, and 200 grams of heptane. This layer was then dried for about 1 minute at 120° C. in a forced air dryer. The resulting hole blocking layer had a dry thickness of 500 Angstroms. An adhesive layer was then deposited by applying a wet coating over the blocking layer, using a gravure applicator or an extrusion coater, and which adhesive contained 0.2 percent by weight based on the total weight of the solution of the copolyester adhesive (ARDEL D100™ available from Toyota Hsutsu Inc.) in a 60:30:10 volume ratio mixture of tetrahydrofuran/monochlorobenzene/methylene chloride. The adhesive layer was then dried for about 1 minute at 120° C. in the forced air dryer of the coater. The resulting adhesive layer had a dry thickness of 200 Angstroms.

A photogenerating layer dispersion was prepared by introducing 0.45 gram of the known polycarbonate IUPILON 200™ (PCZ-200) weight average molecular weight of 20,000, available from Mitsubishi Gas Chemical Corporation, and 44.65 grams of monochlorobenzene (MCB) into a 4 ounce glass bottle. To this solution were added 2.4 grams of titanyl phthalocyanine (Type V) as prepared in Example II, and 300 grams of ⅛ inch (3.2 millimeters) diameter stainless steel shot. This mixture was then placed on a ball mill for 3 hours. Subsequently, 2.25 grams of PCZ-200 were dissolved in 46.1 grams of monochlorobenzene, and added to the titanyl phthalocyanine dispersion. This slurry was then placed on a shaker for 10 minutes. The resulting dispersion was, thereafter, applied to the above adhesive interface with a Bird applicator to form a photogenerating layer having a wet thickness of 0.50 mil. The photogenerating layer was dried at 120° C. for 1 minute in a forced air oven to form a dry photogenerating layer having a thickness of 0.8 micron.

(A) The photogenerating layer was then coated with a single charge transport layer prepared by introducing into an amber glass bottle in a weight ratio of 50/50, N,N'-bis(methylphenyl)-1,1-biphenyl-4,4'-diamine (TBD) and poly(4,4'-isopropylidene diphenyl) carbonate, a known bisphenol A polycarbonate having a $M_w$ molecular weight average of about 120,000, commercially available from Farbenfabriken Bayer A.G. as MAKROLON® 5705. The resulting mixture was then dissolved in methylene chloride to form a solution containing 15.6 percent by weight solids. This solution was applied on the photogenerating layer to form the charge transport layer coating that upon drying (120° C. for 1 minute) had a thickness of 29 microns. During this coating process, the humidity was equal to or less than 30 percent, for example 25 percent.

(B) In another embodiment the resulting photogenerating layer was then coated with a dual charge transport layer. The first charge transport layer was prepared by introducing into an amber glass bottle in a weight ratio of 50/50, N,N'-bis(methylphenyl)-1,1-biphenyl-4,4'-diamine (TBD), and poly(4,4'-isopropylidene diphenyl)carbonate, a known bisphenol A polycarbonate having a $M_w$ molecular weight average of about 120,000, commercially available from Farbenfabriken Bayer A.G. as MAKROLON® 5705. The resulting mixture was then dissolved in methylene chloride to form a solution containing 15.6 percent by weight solids. This solution was applied on the photogenerating layer to form the charge transport layer coating that upon drying (120° C. for 1 minute) had a thickness of 14.5 microns. During this coating process, the humidity was equal to or less than 30 percent, for example 25 percent.

The above first pass charge transport layer (CTL) was then overcoated with a second top charge transport layer in a second pass. The charge transport layer solution of the top layer was prepared as described above for the first bottom layer. This solution was applied, using a 2 mil Bird bar, on the bottom layer of the charge transport layer to form a coating that upon drying (120° C. for 1 minute) had a thickness of 14.5 microns. During this coating process, the humidity was equal to or less than 15 percent. The total two-layer CTL thickness was 29 microns.

Example III

A photoconductor was prepared by repeating the process of Comparative Example 1 (A) except that there was included in the photogenerating layer 5 weight percent of phenazine, which phenazine was added to and mixed with the prepared photogenerating layer solution prior to the coating thereof on the adhesive layer. More specifically, the aforementioned phenazine additive was first dissolved in the photogenerating layer solvent of monochlorobenzene, and then the resulting mixture was added to the above photogenerating components. Thereafter, the mixture resulting was deposited on the adhesive layer.

Example IV

A number of photoconductors are prepared by repeating the process of Comparative Example 1 (A) except that there is included in the photogenerating layer 5 weight percent of at least one of 1-hydroxyphenazine, 1-methoxyphenazine, 10,11-dimethyldibenzo[A,C]phenazine, 11,12-dimethyldibenzo[A,C]phenazine, 11-nitrodibenzo[A,C]phenazine, benzo(A)naphtha[1,2-C]phenazine, 10,11-dichlorodibenzo[A,C]phenazine, and 11-methylthiodibenzo[A,C]phenazine.

Example V

A photoconductor was prepared by repeating the process of Comparative Example 1 (A) except that there was included in the charge transport layer 0.3 weight percent of phenazine, which phenazine was added to and mixed with the prepared charge transport layer solution prior to the coating thereof on the photogenerating layer. More specifically, the aforementioned phenazine additive was first dissolved in the charge transport layer solvent methylene chloride, and then the resulting mixture was added to the above charge transport components. Thereafter, the mixture resulting was deposited on the photogenerating layer.

Example VI

A number of photoconductors are prepared by repeating the process of Example V except that there is selected in place of the charge transport layer phenazine, 0.3 weight percent of at least one of 1-hydroxyphenazine, 1-methoxyphenazine, 10,11-dimethyldibenzo[A,C]phenazine, 11,12-dimethyldibenzo[A,C]phenazine, 11-nitrodibenzo[A,C]phenazine, benzo(A)naphtha[1,2-C]phenazine, 10,11-dichlorodibenzo[A,C]phenazine, and 11-methylthiodibenzo[A,C]phenazine.

Example VII

A photoconductor is prepared by repeating the process of Comparative Example 1 (B) except that there is included in the photogenerating layer 5 weight percent of phenazine, which phenazine is added to and mixed with the prepared photogenerating layer solution prior to the coating thereof on the adhesive layer. More specifically, the aforementioned phenazine additive is first dissolved in the photogenerating layer solvent of monochlorobenzene, and then the resulting mixture is added to the above photogenerating components. Thereafter, the mixture resulting is deposited on the adhesive layer.

Example VIII

A photoconductor is prepared by repeating the process of Comparative Example 1 (B) except that there is included in the bottom charge transport layer 0.6 weight percent of phenazine, which phenazine is added to and mixed with the prepared bottom charge transport layer solution prior to the coating thereof on the photogenerating layer. More specifically, the aforementioned phenazine additive is first dissolved in the bottom charge transport layer solvent of methylene chloride, and then the resulting mixture is added to the above charge transport components. Thereafter, the mixture resulting is deposited on the photogenerating layer.

Electrical Property Testing

The above prepared photoconductors of Comparative Example 1 (A), Examples III and V were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities were measured. Additional electrical characteristics were obtained by a series of charge-erase cycles with incrementing surface potential to generate several voltage versus charge density curves. The scanner was equipped with a scorotron set to a constant voltage charging at various surface potentials. The photoconductors were tested at surface potentials of 500 volts with the exposure light intensity incrementally increased by means of regulating a series of neutral density filters; and the exposure light source was a 780 nanometer light emitting diode. The xerographic simulation was completed in an environmentally controlled light tight chamber at ambient conditions (40 percent relative humidity and 22° C.).

There was substantially no change in the PDIC curves where, more specifically, these curves were essentially the same for each of the above photoconductors.

Charge Deficient Spots (CDS) Measurement

Various known methods have been developed to assess and/or accommodate the occurrence of charge deficient spots. For example, U.S. Pat. Nos. 5,703,487 and 6,008,653, the disclosures of each patent being totally incorporated herein by reference, disclose processes for ascertaining the microdefect levels of an electrophotographic imaging member or photoconductor. The method of U.S. Pat. No. 5,703,487, designated as field-induced dark decay (FIDD), involves measuring either the differential increase in charge over and above the capacitive value, or measuring reduction in voltage below the capacitive value of a known imaging member and of a virgin imaging member, and comparing differential increase in charge over and above the capacitive value or the reduction in voltage below the capacitive value of the known imaging member and of the virgin imaging member.

U.S. Pat. Nos. 6,008,653 (mentioned above) and 6,150,824, the disclosures of each patent being totally incorporated herein by reference, disclose a method for detecting surface potential charge patterns in an electrophotographic imaging member with a floating probe scanner. Floating Probe Micro Defect Scanner (FPS) is a contactless process for detecting surface potential charge patterns in an electrophotographic imaging member. The scanner includes a capacitive probe having an outer shield electrode, which maintains the probe adjacent to and spaced from the imaging surface to form a parallel plate capacitor with a gas between the probe and the imaging surface, a probe amplifier optically coupled to the probe, establishing relative movement between the probe and the imaging surface, and a floating fixture which maintains a substantially constant distance between the probe and the imaging surface. A constant voltage charge is applied to the imaging surface prior to relative movement of the probe and the imaging surface past each other, and the probe is synchronously biased to within about +/−300 volts of the average surface potential of the imaging surface to prevent breakdown, measuring variations in surface potential with the probe, compensating the surface potential variations for variations in distance between the probe and the imaging surface, and comparing the compensated voltage values to a baseline voltage value to detect charge patterns in the electrophotographic imaging member. This process may be conducted with a contactless scanning system comprising a high resolution capacitive probe, a low spatial resolution electrostatic voltmeter coupled to a bias voltage amplifier, and an imaging member having an imaging surface capacitively coupled to and spaced from the probe and the voltmeter. The probe comprises an inner electrode surrounded by and insulated from a coaxial outer Faraday shield electrode, the inner electrode connected to an opto-coupled amplifier, and the Faraday shield connected to the bias voltage amplifier. A threshold of 20 volts is commonly chosen to count charge deficient spots. The above prepared photoconductors (Comparative Example 1 (A), Examples III and V) were measured for CDS counts using the above-described FPS technique, and the results follow in Table 1.

TABLE 1

| | CDS (counts/cm$^2$) |
|---|---|
| Comparative Example 1 (A) | 34 |
| Example III | 6 |
| Example V | 25 |

The above data demonstrates that the CDS of the photoconductor of Example III (with the phenazine in the photogenerating layer) was 6 counts/cm$^2$, and more specifically, only about 20 percent of that as compared to Comparative Example 1 (A) of 34 counts/cm$^2$. Accordingly, the incorporation of the above phenazine into the photogenerating layer substantially reduced the CDS characteristics.

The CDS of the photoconductor of Example V (with the phenazine in the charge transport layer) was 25 counts/cm$^2$, and more specifically, only about 70 percent of that as compared to Comparative Example 1 (A) of 34 counts/cm$^2$. Accordingly, the incorporation of the above phenazine into the charge transport layer also reduced the CDS characteristics.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising a supporting substrate, a photogenerating layer, and at least one charge transport layer comprised of at least one charge transport component, and wherein at least one of said photogenerating layer and said charge transport layer contains a phenazine, and wherein said phenazine is represented by the following structures/formulas

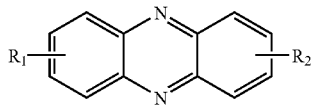

wherein $R_1$ and $R_2$ are each aryl with from about 6 to about 42 carbon atoms.

2. A photoconductor in accordance with claim 1 wherein said phenazine is present in an amount of from about 0.01 to about 25 weight percent.

3. A photoconductor in accordance with claim 1 wherein said phenazine is present in an amount of from about 0.1 to about 15 weight percent.

4. A photoconductor in accordance with claim 1 wherein said phenazine is present in amount of from about 1 to about 8 weight percent based on the weight percent of the photogenerating layer components.

5. A photoconductor in accordance with claim 1 wherein said charge transport component is comprised of at least one of

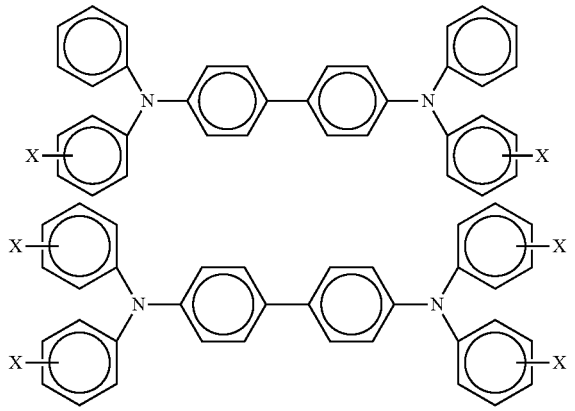

wherein X is selected from the group consisting of at least one of alkyl, alkoxy, aryl, and halogen.

6. A photoconductor in accordance with claim 1 wherein said charge transport component is comprised of

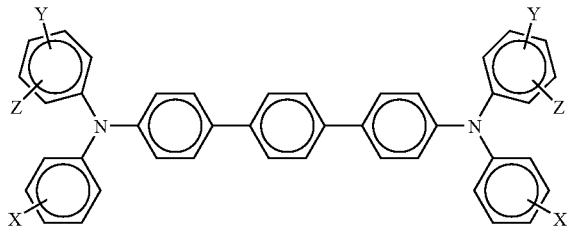

wherein X, Y and Z are independently selected from the group consisting of at least one of alkyl, alkoxy, aryl, and halogen.

7. A photoconductor in accordance with claim 1 wherein said charge transport component is an aryl amine selected from the group consisting of N,N'-diphenyl-N,N-bis(3-methylphenyl)-1,1'-biphenyl-4,4'-diamineN,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine, and mixtures thereof; wherein said at least one charge transport layer is from 1 to about 4, and wherein said phenazine, is present in an amount of from about 0.3 to about 7 weight percent.

8. A photoconductor in accordance with claim 1 further including in at least one of said charge transport layers an antioxidant comprised of at least one of a hindered phenolic and a hindered amine, and wherein said at least one charge transport layer is from 1 to about 3.

9. A photoconductor in accordance with claim 1 wherein said photogenerating layer is comprised of at least one photogenerating pigment, and said phenazine.

10. A photoconductor in accordance with claim 9 wherein said photogenerating pigment is comprised of at least one of a perylene, a metal phthalocyanine, and a metal free phthalocyanine.

11. A photoconductor in accordance with claim 9 wherein said photogenerating pigment is comprised of at least one of chiorogallium phthalocyanine, hydroxygallium phthalocyanine, and titanyl phthalocyanine.

12. A photoconductor in accordance with claim 1 further including a hole blocking layer, and an adhesive layer.

13. A photoconductor in accordance with claim 1 wherein said at least one charge transport layer is comprised of a top charge transport layer and a bottom charge transport layer, and wherein said top layer is in contact with said bottom layer and said bottom layer is in contact with said photogenerating layer; and wherein said top and said bottom charge transport layer contain N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine, or mixtures thereof.

14. A photoconductor in accordance with claim 1 wherein said phenazine is present in said photogenerating layer in an amount of from about 0.5 to about 20 weight percent, in a resin binder; said charge transport component is N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, or N,N'-diphenyl-N,N'-bis(3-chlorophenyl)-[p-terphenyl]-4,4'-diamine; and wherein said at least one charge transport layer is from 1 to about 3, and wherein said phenazine is present in at least one charge transport layer in an amount of from about 1 to about 7 weight percent.

15. A photoconductor in accordance with claim 1 wherein said phenazine is present in said charge transport layer, in an amount of from about 0.05 to about 10 weight percent, in a resin binder; said charge transport component is N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, or N,N'-diphenyl-N,N'-bis(3-chlorophenyl)-[p-terphenyl]-4,4'-diamine, and wherein said at least one charge transport layer is from 1 layer to about 3 layers.

16. A photoconductor comprised in sequence of a photogenerating layer, and a charge transport layer; and wherein said photogenerating layer contains a phenazine and a photogenerating pigment, wherein said phenazine is present in an amount of from about 0.1 to about 20 weight percent, and wherein said phenazine is represented by the following structures/formulas wherein $R_1$ and $R_2$ are each aryl with from about 6 to about 42 carbon atoms

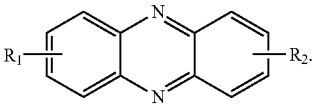

17. A photoconductor comprising a supporting substrate, a photogenerating layer, and a charge transport layer; and wherein said charge transport layer is comprised of at least one charge transport component and a phenazine, and wherein said phenazine is represented by the following structures/formulas

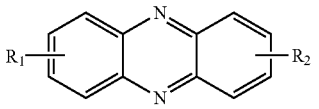

wherein $R_1$ and $R_2$ are each aryl with from about 6 to about 42 carbon atoms.

18. A photoconductor in accordance with claim 17 wherein said phenazine is present in an amount of from about 0.1 to about 5 weight percent.

19. A photoconductor in accordance with claim 17 wherein said charge transport layer is a hole transport layer, and said photogenerating layer and said hole transport layer each further contains a resin binder.

20. A photoconductor in accordance with claim 17 wherein said photogenerating layer contains a resin binder and a photogenerating pigment of a titanyl phthalocyanine Type V, and wherein said phenazine is present in an amount of from about 0.1 to about 5 weight percent.

* * * * *